US008657288B2

(12) United States Patent
Fletcher et al.

(10) Patent No.: US 8,657,288 B2
(45) Date of Patent: Feb. 25, 2014

(54) THREE-DIMENSIONAL PUZZLE

(75) Inventors: Stuart D. Fletcher, Linden, MI (US); Scott A. Owen, Columbiaville, MI (US); Michael A. Hall, Clarkston, MI (US)

(73) Assignee: Iconic Holdings, Inc., Fenton, MI (US)

( * ) Notice: Subject to any disclaimer, the term of this patent is extended or adjusted under 35 U.S.C. 154(b) by 56 days.

(21) Appl. No.: 13/259,814

(22) PCT Filed: Apr. 8, 2010

(86) PCT No.: PCT/US2010/030386

§ 371 (c)(1), (2), (4) Date: Sep. 23, 2011

(87) PCT Pub. No.: WO2010/118227

PCT Pub. Date: Oct. 14, 2010

(65) Prior Publication Data

US 2012/0018949 A1 Jan. 26, 2012

Related U.S. Application Data

(60) Provisional application No. 61/167,656, filed on Apr. 8, 2009, provisional application No. 61/184,885, filed on Jun. 8, 2009.

(51) Int. Cl.
*A63F 9/10* (2006.01)

(52) U.S. Cl.
USPC ..... 273/157 R; 446/124

(58) Field of Classification Search
USPC ..... 273/153 R, 156, 157 R; 446/124
See application file for complete search history.

(56) References Cited

U.S. PATENT DOCUMENTS

| | | | | |
|---|---|---|---|---|
| 2,299,730 | A | 10/1942 | Bornstein | |
| 3,578,331 | A | 5/1971 | DeGast | |
| 3,618,955 | A | 11/1971 | Barnes | |
| 3,704,892 | A | 12/1972 | Moravick et al. | |
| 3,851,884 | A | 12/1974 | Myller | |
| 3,865,382 | A | 2/1975 | Myller | |
| 4,345,762 | A | 8/1982 | Lebelson | |
| 4,469,331 | A | 9/1984 | Rinker | |
| 4,557,484 | A | 12/1985 | Sherman, Jr. et al. | |
| 4,943,684 | A | 7/1990 | Kramer | |
| 5,090,935 | A | 2/1992 | Monson | |
| 5,100,359 | A | 3/1992 | Gorio | |
| 5,104,125 | A | 4/1992 | Wilson | |
| 5,230,508 | A | 7/1993 | Tabler | |
| 5,429,364 | A * | 7/1995 | Chang | 273/153 S |
| D378,263 | S | 3/1997 | Lage | |
| 5,826,873 | A | 10/1998 | Lavermicocca | |

(Continued)

FOREIGN PATENT DOCUMENTS

WO 2010/118227 A1 10/2010

*Primary Examiner* — Vishu K. Mendiratta
(74) *Attorney, Agent, or Firm* — Brooks Kushman P.C.

(57) ABSTRACT

A three dimensional puzzle assembly 12 is formed of a plurality of puzzle pieces 18. The puzzle pieces 18 have tabs 28 that are received in recesses 30. The tabs 28 and recesses 30 have cooperating engagement features 32, 34 that prevent adjacent puzzle pieces from being displaced in a direction normal to an exterior surface of the puzzle pieces. The puzzle assembly 12 defines a guide 24 in which a lock 20 may be attached. A bayonet connector 88, 90 may be used to attach a liner 14 to the lock through a hole 52 in the puzzle assembly. A retainer 54 on the liner 14 may pass through the hole 52 and engage the lock 20.

14 Claims, 4 Drawing Sheets

(56) References Cited

U.S. PATENT DOCUMENTS

| | | | | |
|---|---|---|---|---|
| 5,840,377 | A * | 11/1998 | Donnell | 428/33 |
| 5,895,306 | A | 4/1999 | Cunningham | |
| D427,017 | S | 6/2000 | Reimer | |
| 6,073,929 | A * | 6/2000 | Nahon | 273/156 |
| 6,116,979 | A | 9/2000 | Weber | |
| 6,186,855 | B1 | 2/2001 | Bauer et al. | |
| 6,199,865 | B1 | 3/2001 | Goldman | |
| 6,237,914 | B1 | 5/2001 | Saltanov et al. | |
| D455,047 | S | 4/2002 | Wolfe et al. | |
| D455,048 | S | 4/2002 | Marck | |
| 6,398,221 | B1 | 6/2002 | Graham | |
| 6,416,054 | B1 | 7/2002 | Alfassi | |
| 6,601,849 | B1 | 8/2003 | Konkle et al. | |
| D487,555 | S | 3/2004 | Hurlbut | |
| D519,166 | S | 4/2006 | Chuang | |
| 7,021,625 | B2 | 4/2006 | Simmons | |
| D520,376 | S | 5/2006 | Nolle | |
| 7,311,306 | B2 | 12/2007 | Chuang | |
| D563,236 | S | 3/2008 | Claffey | |
| 7,490,831 | B2 | 2/2009 | Simmons | |
| D606,809 | S | 12/2009 | Fletcher | |
| 2005/0194738 | A1 | 9/2005 | Simmons | |
| 2009/0039600 | A1 | 2/2009 | Lucas | |
| 2009/0127784 | A1 | 5/2009 | Paquette | |

* cited by examiner

Section A-A

THREE-DIMENSIONAL PUZZLE

CROSS-REFERENCE TO RELATED APPLICATIONS

This application claims the benefit of U.S. Provisional Application No. 61/167,656 filed Apr. 8, 2009, and U.S. Provisional Application No. 61/184,885 filed Jun. 8, 2009.

TECHNICAL FIELD

Three dimensional jigsaw puzzles and containers incorporating three dimensional jigsaw puzzles.

BACKGROUND

Jigsaw puzzles are generally flat with edges of adjacent puzzle pieces cut in such a way as to allow the puzzle pieces to fit together to form a picture. The puzzle pieces are normally assembled on a planar supporting surface and are not subject to displacement normal to the surface of the puzzle. Three dimensional puzzles add the element of a shape to the puzzle. Free standing three dimensional puzzles connect adjacent pieces using traditional tab and recess cuts. Traditional tab and recess cuts are not designed to withstand forces normal to the surface of the puzzle.

Containers can be used to hold items or liquids. Containers such as cups have long been decorated with graphic designs to facilitate use as promotional items. It is thought that there is a potential demand for promotional items that foster concepts such as cooperation, fitting a team together or building something.

SUMMARY

According to one aspect of applicant's disclosure, a container is disclosed that includes a liner in which a liquid may be retained. The liner is placed within a free-standing three dimensional puzzle that is made up of a plurality of puzzle pieces. The liner and assembled puzzle pieces are connected by a lock that may comprise a handle of the container.

According to another aspect of the disclosure, a puzzle assembly is disclosed that has interfitting tabs and recesses that cooperate to form a self-supporting three dimensional puzzle. The tabs have lips that engage ledges on the recesses to resist displacement of adjacent puzzle pieces.

According to yet another aspect of the disclosure, a container is provided that includes a liner, a plurality of puzzle pieces, and means for connecting adjacent puzzle pieces together about the liner as shown and described.

In addition to the above aspects of the applicant's disclosure, additional aspects are disclosed that add further novel aspects to the disclosure. One additional aspect relates to providing engagement features that cooperate to inhibit displacement of adjacent puzzle pieces in a direction normal to the exterior surfaces of the puzzle pieces. Another aspect relates to providing a puzzle assembly that defines a guide into which the lock slides to lock the puzzle assembly together. A retainer may be provided on the liner that extends through a hole in the puzzle assembly to the lock to selectively prevent the lock from sliding relative to the guide. In one version of the disclosure, the liner may be connected to the puzzle assembly with a twist-lock or bayonet type connection.

Other aspects of applicant's disclosure that may be provided if desired relate to a puzzle assembly that includes top puzzle pieces and bottom puzzle pieces. The bottom puzzle pieces may have a base wall and a peripheral wall. The top and bottom puzzle pieces may each have a beveled tab or recess that facilitates assembly of the top puzzle pieces to the bottom puzzle pieces.

The above described aspects and other aspects of applicants disclosure will be better understood by those of ordinary skill in the art in view of the attached drawings and the following detailed description.

DETAILED DESCRIPTION

Figure 1:
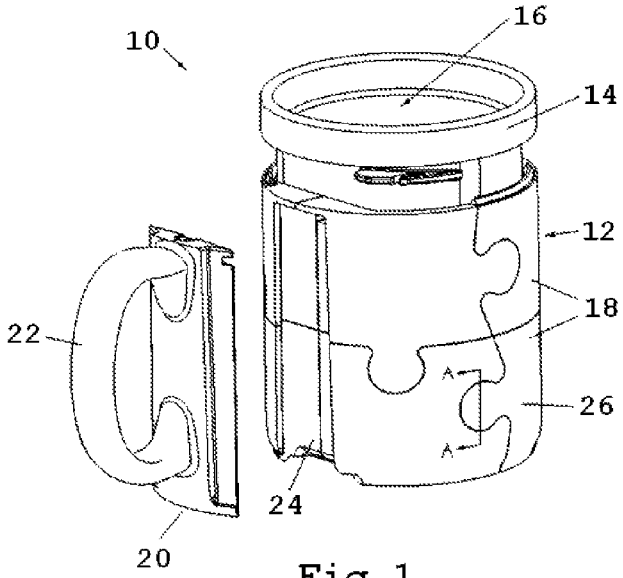
FIG. 1 is a partially exploded perspective view of the container in which the liner is partially disposed within the fully assembled puzzle assembly and the handle removed.
Figure 2:
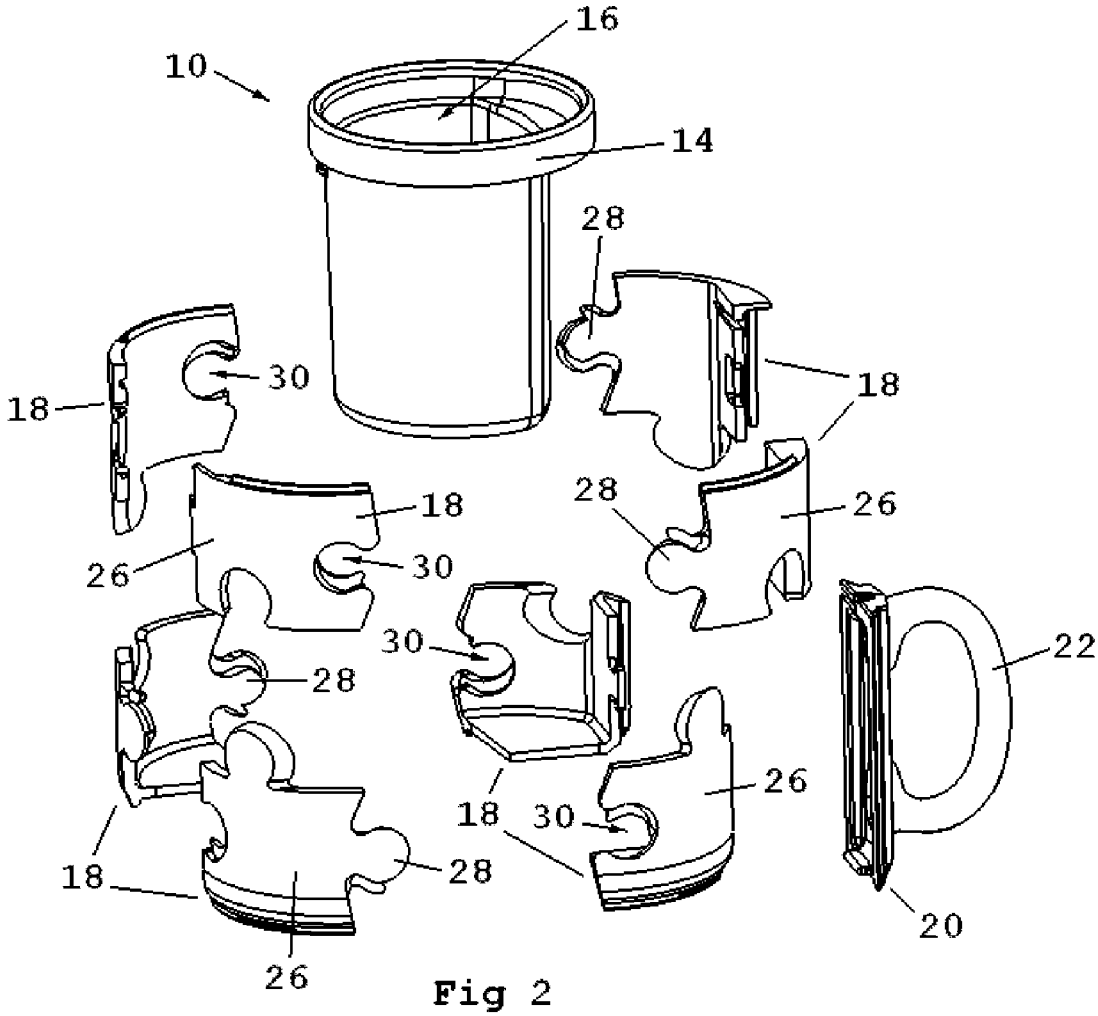
FIG. 2 is an exploded perspective view of the container.

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

With reference to FIGS. 1 through 4, a container 10 and a self-supporting puzzle assembly 12 are shown. The container 10 is shown with a liner 14 that defines an interior space 16 that may be disposed within a plurality of puzzle pieces 18 assembled together to form the self-supporting puzzle assembly 12 about the liner 14. A lock 20, which in this embodiment includes a handle 22 but is not necessary, that may be slid into a guide 24 defined by the puzzle assembly 12 to connect the puzzle assembly 12 to the liner 14.

The puzzle pieces 18, liner 14 and lock 20, in this embodiment, are injection molded parts using materials such as ABS (acrylonitrile butadiene styrene), SAN (styrene acrylonitrile resin), or acrylic (acrylic fiber or acrylic resin). However, any thermosetting plastic known in the art may be used. As well, the components in the container 10 may be made from many different materials including thermoplastics, plastics, polymers, rubbers, glass, wood, plaster, metals, steel, aluminum, foam, soap or paper products such as paperboard, pasteboard, corrugated fiberboard or other similar compressible medium, or any combination of the above.

Components within container 10, specifically with respect to the puzzle pieces 18, may be a colored or non-colored opaque, colored or non-colored translucent or transparent material. Surfaces of all of the components may be painted with graphic designs or marked with indicia.

While all of the puzzle pieces 18 have an exterior surface 26, only some of the puzzle pieces 18 have a tab 28, and only some of the puzzle pieces 18 define a recess 30 that receives one of the tabs 28 when assembled. However, each puzzle piece 18 has at least one tab 28 or at least one recess 30. Tabs and recesses are also known to those in the puzzle art as knobs, chads, "innies", "outies", C-cuts, S-cuts, and more.

Each tab 28 is provided with a first engagement feature 32. Each recess 30 defines a second engagement feature 34. The first engagement feature 32 of one puzzle piece 18 connects to the second engagement feature 34 of an adjacent puzzle piece 18 to inhibit displacement normal to the exterior surface 26 of the adjacent puzzle pieces 18. The first engagement feature 32 has a first lip 36 on a first edge 38 and a second lip 40 on a second edge 42. The second engagement feature 34 has a first ledge 44 on a third edge 46 and a second ledge 48 on a fourth edge 50. The first engagement feature 32 connects with the second engagement feature 34 such that the first ledge 44 receives the first lip 36 and the second ledge 48 receives the second lip 40.

Figure 5:
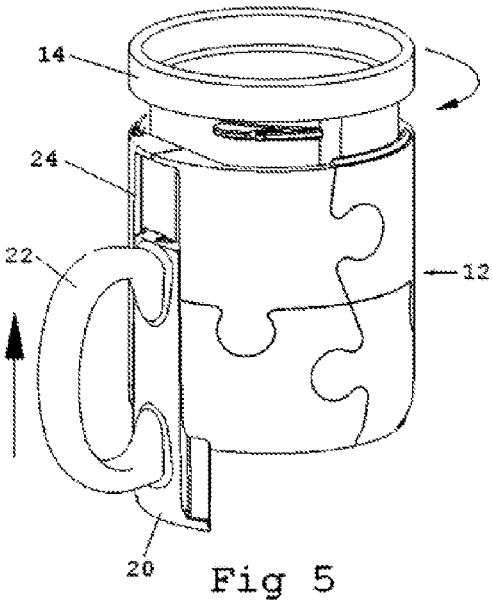
FIG. 5 is a partially exploded perspective view of the container illustrating how the lock slides relative to the guides and the liner is connected by a twist-lock or bayonet type connector.

With reference to FIG. 5, the container 10 is shown with the liner 14 partially disposed within the puzzle assembly 12. The puzzle assembly 12 defines a guide 24. The lock 20, which in this example has a handle 22, slides into the guide 24 when assembled. The liner 14 may then be twisted and locked in position by a twist-lock or bayonet connector (to be described in more detail below with reference to FIG. 11).

Figure 6:
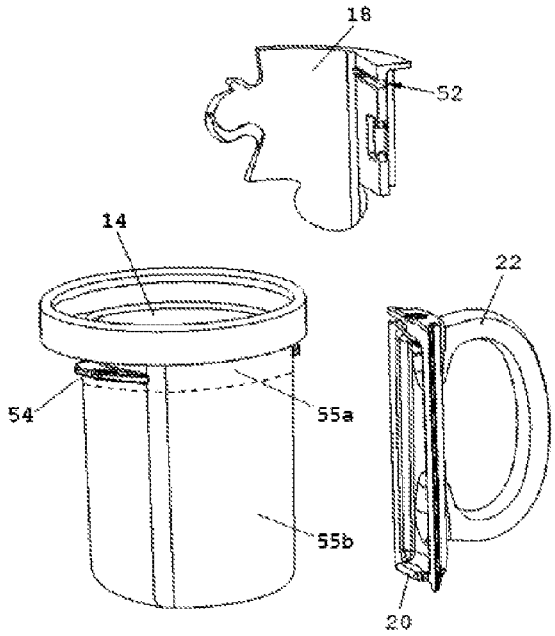
FIG. 6 is a partially exploded perspective view of a single puzzle piece that includes the hole in which the retainer on the liner passes through to connect with the lock.
Figure 7:
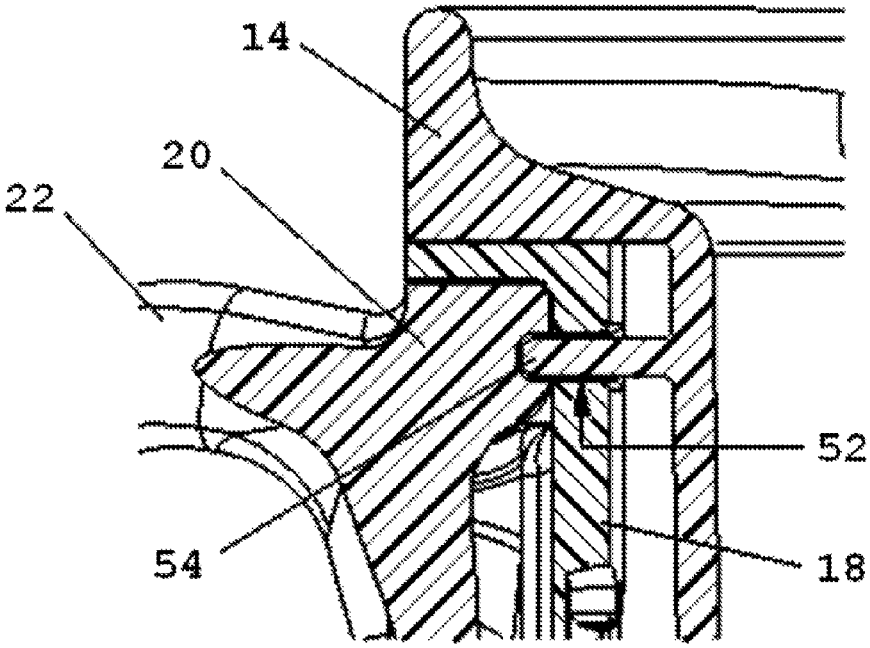
FIG. 7 is an enlarged cross-sectional view of the container showing the hole in the puzzle piece in which the retainer on the liner passes through to connect with the lock.

With reference to FIGS. 6 and 7, at least one of the puzzle pieces 18 defines a hole 52. The liner 14 has a retainer 54 that extends through the hole 52 and connects to the lock 20 to prevent the lock from sliding relative to the guide 24 (as shown in FIG. 5).

Figure 8:
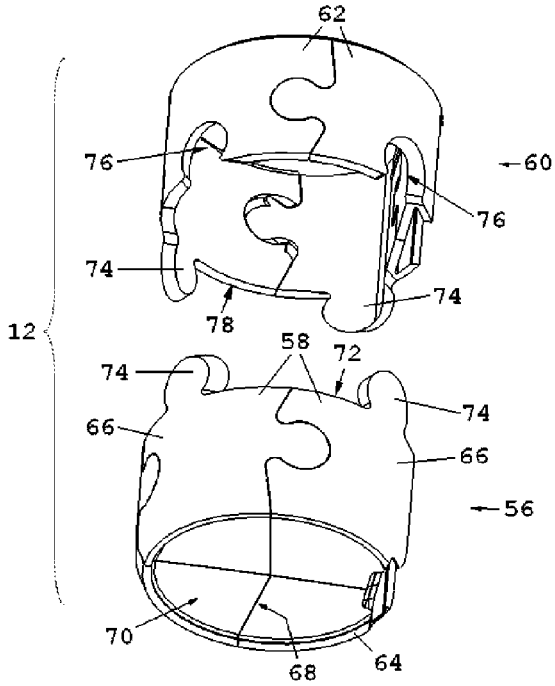
FIG. 8 is a partially exploded perspective view from the bottom of the exterior puzzle assembly in which the top sub-assembly is fully assembled, the bottom sub-assembly is fully assembled, and the top and bottom sub-assemblies are separated.

With reference to FIG. 8, the puzzle assembly 12 has a bottom sub-assembly 56 having a plurality of bottom puzzle pieces 58 and a top sub-assembly 60 having a plurality of top puzzle pieces 62. The bottom puzzle pieces 58 each have a base wall 64, a peripheral wall 66 and a bottom edge 68. The base walls 64 extend inwardly from the peripheral walls 66 such that each edge 68 of each base wall 64 is juxtaposed along the edge 68 of an adjacent base wall 64 to create a substantially uninterrupted base surface 70. A substantially uninterrupted base surface 70 means that the bottom puzzle pieces 58 are abutted along their edges 68. The edges need not necessarily have perfect line to line contact. The bottom puzzle pieces 58 and top puzzle pieces 62 respectively connect around a periphery using corresponding tabs 28 and recesses 30.

Figure 3:
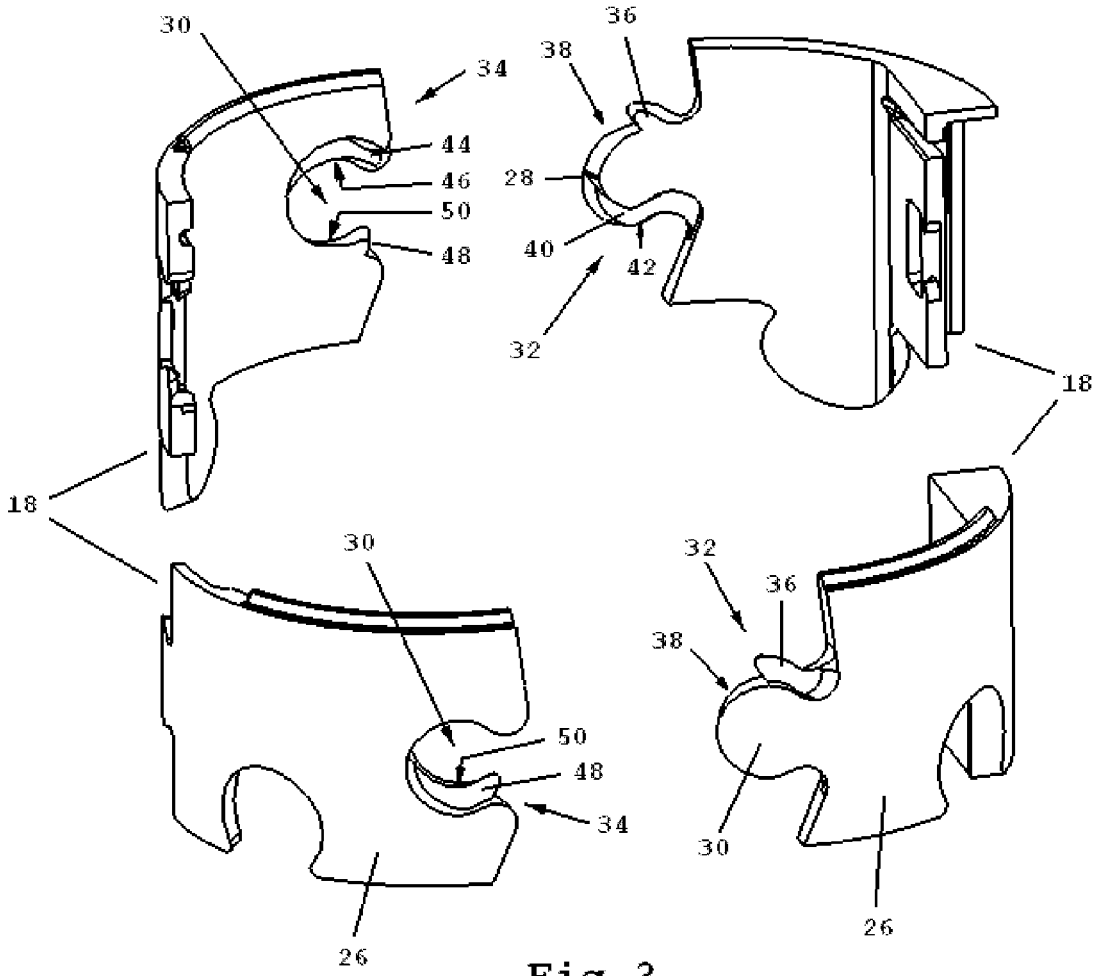
FIG. 3 is an exploded perspective view of the top sub-assembly of the puzzle assembly.
Figure 4:
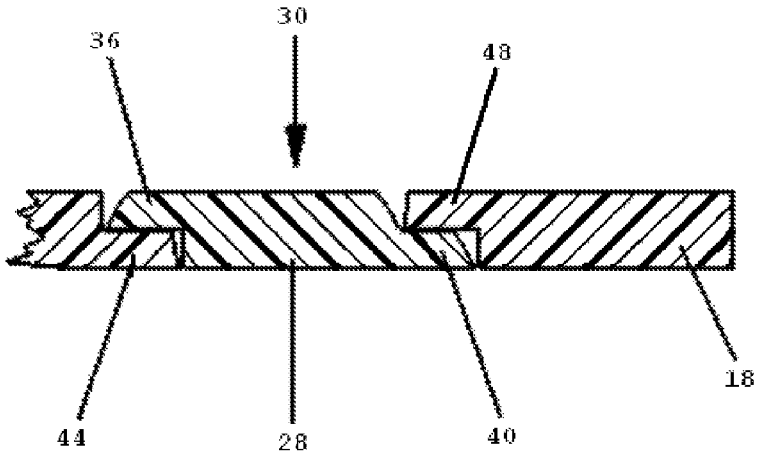
FIG. 4 is a cross-sectional view of the tab and recess engagement of FIG. 1.

The bottom sub-assembly 56 has bottom puzzle pieces 58 each having a top edge 72 that either has at least one beveled tab 74 or defines at least one beveled recess 76. The top sub-assembly 60 has top puzzle pieces 62 each having a bottom edge 78 that either has at least one beveled tab 74 or defines at least one beveled recess 76. Beveled tabs 74 and beveled recesses 76 do not have lips 36, 40 or ledges 44, 48 as previously described with tabs 28 or recesses 30 (as shown in FIG. 3). The top sub-assembly 60 is connected to the bottom sub-assembly 56 such that the top sub-assembly bottom edge 78 beveled tabs 74 and beveled recesses 76 connect with corresponding bottom sub-assembly top edge 72 beveled tabs 74 and beveled recesses 76 to create a complete self-supporting exterior puzzle assembly (as shown in FIG. 1).

Figure 9A:
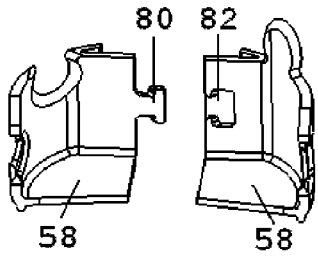
FIG. 9A is a perspective view of adjacent top puzzle pieces illustrating the hook and notch connecting features disassembled.
Figure 9B:
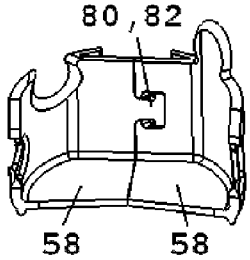
FIG. 9B is a perspective view of adjacent top puzzle pieces illustrating the hook and notch connecting features connected.

With reference to FIGS. 9A and 9B, one of the bottom puzzle pieces 58 has at least one first hook 80, and an adjacent bottom puzzle piece 58 has at least one first notch 82. The bottom puzzle pieces connect around a periphery using corresponding tabs and recesses (as shown in FIG. 8), such that the last two adjacent bottom puzzle pieces 58 connect using the first hook 80 and the first notch 82. FIG. 9A shows two adjacent bottom puzzle pieces 58 apart and FIG. 9B shows two adjacent bottom puzzle pieces 58 connected.

Figure 10A:
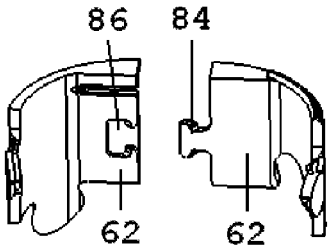
FIG. 10A is a perspective view of adjacent bottom puzzle pieces illustrating the hook and notch connecting features disassembled.
Figure 10B:
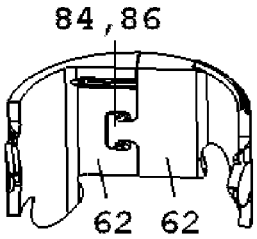
FIG. 10B is a perspective view of adjacent bottom puzzle pieces illustrating the hook and notch connecting features connected.

Similarly, referring to FIG. 10, one of the top puzzle pieces 62 has a second hook 84, and an adjacent top puzzle piece 62 has a second notch 86. The top puzzle pieces connect around a periphery using corresponding tabs and recesses (as shown in FIG. 8), such that the last two adjacent top puzzle pieces 62 connect using the second hook 84 and the second notch 86. FIG. 10A shows two adjacent top puzzle pieces 62 apart and FIG. 10B shows two adjacent top puzzle pieces 62 connected.

Figure 11:
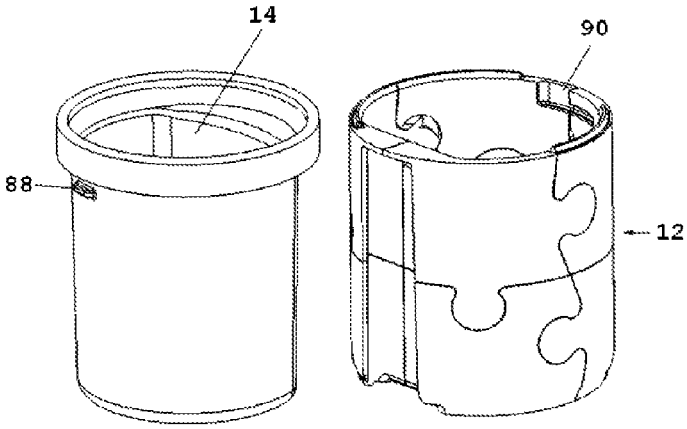
FIG. 11 is a perspective view of the liner and exterior puzzle assembly side-by-side illustrating the first and second parts of the twist-lock or bayonet connector.

With reference to FIG. 11 the puzzle assembly 12 and the liner 14 are shown side-by-side. The liner 14 has a first part of a bayonet connector 88, and the puzzle assembly 12 has a second part of a bayonet connector 90. The first part of the bayonet connector 88 is coupled with the second part of the bayonet connector 90 to connect the liner to the puzzle assembly. The first part of the bayonet connector 88 slides down into the second part of the bayonet connector 90 and then twisted into position when assembled. A bayonet connector, as shown in this embodiment, is a fastening mechanism consisting of a male side with one or more pins, and a female receptor with matching L slots, however it is to be understood that a twist-lock fastener or threaded fastener may be used as an alternative to the bayonet connector.

While exemplary embodiments are described above, it is not intended that these embodiments describe all possible forms of the disclosed concept. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A puzzle assembly comprising:

A plurality of puzzle pieces each have an exterior surface, an opposing surface opposite the exterior surface, and at least two adjacent puzzle pieces each having at least one tab or at least one recess, in which at least one of the recesses receives one of the tabs, wherein some of the tabs have a first lip disposed along the opposing surface and at a first edge, a second lip disposed along the exterior surface and at a second edge opposite the first edge, some of the recesses have a first ledge disposed along the exterior surface and at a third edge, a second ledge disposed along the opposing surface and at a forth edge opposite the third edge, and the recess of at least one puzzle piece receives the tab of the adjacent puzzle piece such that the first ledge contacts the first lip and the second ledge contacts the second lip to inhibit displacement normal to the exterior surface of the adjacent puzzle pieces.

2. The puzzle assembly of claim 1, wherein the puzzle assembly comprises a bottom sub-assembly having a plurality of bottom puzzle pieces and a top sub-assembly having a plurality of top puzzle pieces, and the plurality of bottom puzzle pieces each have a base wall and a peripheral wall, in which the base walls extend inwardly from the peripheral walls such that each edge of each base wall is juxtaposed along the edge of an adjacent base wall to create a substantially uninterrupted base surface.

3. The puzzle assembly of claim 1, wherein the puzzle assembly comprises a bottom sub-assembly having a plurality of bottom puzzle pieces connect around a circular periphery in which at least one bottom puzzle piece has the recess with the first ledge and the second ledge, an adjacent bottom puzzle piece has the tab with the first lip and the second lip, and that the recess of the at least one bottom puzzle piece receives the tab of the adjacent bottom puzzle piece; and one of the bottom puzzle pieces has at least one first hook, and an adjacent bottom puzzle piece has at least one first notch, such that the last two adjacent bottom puzzle pieces connect using the first hook and the first notch.

4. The puzzle assembly of claim 1, wherein the puzzle assembly comprises a top sub-assembly having a plurality of top puzzle pieces connect around a circular periphery in which at least one top puzzle piece has the recess with the first ledge and the second ledge, an adjacent top puzzle piece has the tab with the first lip and the second lip, and that the recess of the at least one top puzzle piece receives the tab of the adjacent top puzzle piece; and one of the top puzzle pieces has a second hook, and an adjacent top puzzle piece has a second notch, such that the last two adjacent top puzzle pieces connect using the second hook and the second notch.

5. The puzzle assembly of claim 1, wherein the puzzle assembly comprises a bottom sub-assembly having a plurality of bottom puzzle pieces and a top sub-assembly having a plurality of top puzzle pieces, and the bottom sub-assembly has bottom puzzle pieces each having a top edge that either has at least one beveled tab or defines at least one beveled recess;

the top sub-assembly has top puzzle pieces each having a bottom edge that either has at least one beveled tab or defines at least one beveled recess; and the top sub-assembly is connected to the bottom sub-assembly such that the top sub-assembly bottom edge beveled tabs and beveled recesses connect with corresponding bottom sub-assembly top edge beveled tabs and beveled recesses to create a self-supporting exterior puzzle assembly.

6. The puzzle assembly of claim 1, further comprising:

a liner that defines an interior space, in which the liner is slidably insertable within the plurality of puzzle pieces; and a lock that couples the liner to at least one of the plurality of puzzle pieces.

7. The puzzle assembly of claim 6, wherein the liner has a first part of a bayonet connector, and at least one of the plurality of puzzle pieces has a second part of a bayonet connector, wherein the first part of the bayonet connector is coupled with the second part of the bayonet connector to connect the liner to the at least one of the puzzle pieces.

8. The puzzle assembly of claim 6, wherein some of the plurality of puzzle pieces define a substantially straight guide and the lock slides relative to the guide.

9. The puzzle assembly of claim 6, wherein at least one of the plurality of puzzle pieces defines a hole, the liner has a retainer that extends through the hole and connects to the lock such that the at least one of the plurality of puzzle pieces defining the hole is disposed between the liner and the lock and the liner is coupled to the at least one of the plurality of puzzle pieces.

10. The puzzle assembly of claim 6, wherein the plurality of puzzle pieces, liner and lock form a container.

11. The puzzle assembly of claim 1, wherein the first lip is offset and generally opposite the second lip on the tab, such that the tab has a generally Z-shaped cross section through the first lip and second lip, and the first ledge is offset and generally opposite the second ledge within the recess, such that the recess has a generally Z-shaped cross-section through the first ledge and second ledge to receive the generally Z-shaped cross-section of the tab.

12. The puzzle assembly of claim 1, wherein at least two adjacent puzzle pieces of the plurality of puzzle pieces are adjacent non-flat puzzle pieces, and the first lip of one of the adjacent non-flat puzzle pieces is contactable with the first ledge of the other adjacent non-flat puzzle piece to provide support in at least a direction normal to the adjacent non-flat puzzle pieces, the second lip of the one adjacent non-flat puzzle pieces is contactable with the second ledge of the other adjacent non-flat puzzle piece to provide support in at least a direction normal to the adjacent non-flat puzzle pieces, and the shape of the tab of the one adjacent non-flat puzzle pieces is connectable with the shape of the recess of the other adjacent non-flat puzzle piece to provide support in at least directions tangential to and along the exterior surface 90° to the tangential direction of the adjacent non-flat puzzle pieces, wherein the support provided yields a triangulation of support in all three axis of movement.

13. The puzzle assembly of claim 1, wherein the puzzle pieces of the at least one puzzle piece that has the recess that receives the tab of the adjacent puzzle piece such that the first ledge receives the first lip and the second ledge receives the second lip have a generally zig-zag cross-section appearance when the cross-section is taken through the first and second lips and ledges.

14. A three-dimensional puzzle comprising:

a plurality of non-flat puzzle pieces, wherein adjacent non-flat puzzle pieces are assemblable together to form a self-supporting exterior puzzle assembly defining an interior space;

a ring segment attachable to at least a portion of the exterior puzzle assembly, wherein the ring segment is at least partially disposable within the interior space of the external puzzle assembly, providing additional support for the exterior puzzle assembly; and a lock, wherein the exterior puzzle assembly defines a hole, the ring segment defines a retainer which is extendable through the hole of the exterior puzzle assembly, and the lock and retainer are connectable and elastically deformable to provide an interference fit securing at least a portion of the exterior puzzle assembly between the lock and the retainer.

* * * * *